US007476030B1

(12) United States Patent
Kuge et al.

(10) Patent No.: US 7,476,030 B1
(45) Date of Patent: Jan. 13, 2009

(54) FASTENER BAG AND FASTENER DEVICE

(75) Inventors: Raizo Kuge, Hannou (JP); Sho Obara, Koshigaya (JP); Yuichi Oki, Tokyo-To (JP)

(73) Assignees: Kabushiki Kaisha Hosokawa Yoko, Tokyo-To (JP), part interest; Idemitsu Unitech Co., Ltd., Tokyo-To (JP), part interest; Idemitsu Kosan Co., Ltd., Tokyo-To (JP), part interest ( * ) Notice: Subject to any disclaimer, the term of this patent is extended or adjusted under 35 U.S.C. 154(b) by 234 days.

(21) Appl. No.: 10/380,677

(22) PCT Filed: Sep. 18, 2000

(86) PCT No.: PCT/JP00/06363

§ 371 (c)(1),
(2), (4) Date: Aug. 4, 2003

(87) PCT Pub. No.: WO02/22452

PCT Pub. Date: Mar. 21, 2002

(51) Int. Cl.
*B65D 33/00* (2006.01)
*B65D 33/16* (2006.01)

(52) U.S. Cl. ..... 383/203; 383/61.2; 383/63; 383/66; 383/205

(58) Field of Classification Search ..... 383/61.2, 383/66, 203–204, 63, 205, 31.2
See application file for complete search history.

(56) References Cited

U.S. PATENT DOCUMENTS 3,532,571 A * 10/1970 Ausnit ..... 156/91
4,252,238 A * 2/1981 Spiegelberg et al. ..... 383/210.1
4,528,224 A * 7/1985 Ausnit ..... 428/35.5
4,570,820 A * 2/1986 Murphy ..... 221/34
4,876,842 A * 10/1989 Ausnit ..... 53/410
5,121,997 A * 6/1992 La Pierre et al. ..... 383/203
5,215,380 A * 6/1993 Custer et al. ..... 383/203
5,412,924 A * 5/1995 Ausnit ..... 53/412
5,782,733 A * 7/1998 Yeager ..... 493/213
6,224,262 B1 * 5/2001 Hogan et al. ..... 383/203
6,481,183 B1 * 11/2002 Schmidt ..... 53/412
6,918,234 B2 * 7/2005 Thomas et al. ..... 53/412

(Continued)

FOREIGN PATENT DOCUMENTS

EP 345930 A1 * 12/1989 ..... 383/63

(Continued)

*Primary Examiner*—Jes F Pascua
(74) *Attorney, Agent, or Firm*—Birch, Stewart, Kolasch & Birch, LLP

(57) ABSTRACT

A fastener bag includes a packaging bag formed by heat-sealing side parts of a packaging sheet in a butt seam, and a fastening device attached to the inner surface of the packaging bag. The fastening device includes a male fastening member and a female fastening member. The male fastening member is disposed on one side of the heat-sealed butt seam of the packaging bag, and the female fastening member is disposed on the other side of the heat-sealed butt seam of the packaging bag so as to be engage with the male fastening member, and a tear-facilitating means is interposed between the male and the female fastening member. The fastener bag is capable of being opened and of being reclosed, and is suitable for use on an automatic filling and packaging machine.

9 Claims, 13 Drawing Sheets

U.S. PATENT DOCUMENTS

| | | | | | |
|---|---|---|---|---|---|
| 2004/0114838 | A1 * | 6/2004 | McGregor | ..... | 383/204 |

FOREIGN PATENT DOCUMENTS

| | | | | | |
|---|---|---|---|---|---|
| EP | 0 423 456 | A1 | | 4/1991 | |
| EP | 0 481 783 | A2 | | 4/1992 | |
| EP | 000528721 | A2 | * | 2/1993 | ..... 383/66 |
| JP | 63-147451 | U | | 9/1988 | |
| JP | 03-056248 | A | | 3/1991 | |
| JP | 3-56248 | A | | 3/1991 | |
| JP | 4-253644 | A | | 9/1992 | |
| JP | 06156510 | A | * | 6/1994 | ..... 383/63 |
| JP | 6-80652 | U | | 11/1994 | |
| JP | 08-133303 | A | | 5/1996 | |
| JP | 10-29644 | A | | 2/1998 | |
| JP | 11-124150 | A | | 5/1999 | |

* cited by examiner

FASTENER BAG AND FASTENER DEVICE

This application is the national phase under 35 U.S.C. § 371 of PCT International Application No. PCT/JP00/06363 which has an International filing date of Sep. 18, 2000, which designated the United States of America.

TECHNICAL FIELD

The present invention relates to a fastener bag capable of being easily opened and reclosed, and of being applied to packaging an article therein by an automatic filling and packaging machine, and a fastening device.

BACKGROUND ART

Recently, most packaging bags are required to have both a capability to be easily opened and a capability to be reclosed. The field of automatic filling and packaging, in which operations for filling and packaging an article in a packaging bag are carried out simultaneously, requests a fastener bag having both a capability to be opened and a capability to be reclosed.

A known fastener bag having both a capability to be opened and a capability to be reclosed is made by superposing two packaging sheets, heat-sealing peripheral parts of the superposed packaging sheets, attaching the male fastening member of a fastening device to the inner surface of one of the packaging sheets, and attaching the female fastening member of the fastening device to the inner surface of the other packaging sheet. The male and the female fastening member are disengaged to open the fastener bag, and are reengaged to reclose the fastener bag.

A known easy-to-open fastener bag is formed from a packaging material having a property of facilitating opening the fastener bag, another packaging bag is provided with a notch, and a third known fastener bag is provided with a filament attached to its component sheet.

Although the foregoing fastener bag has both a capability to be opened easily and a capability to be reclosed, a bag making process of making the fastener bag, a filling and packaging process need complicated work because the fastener bag is made by superposing the two packaging sheets and heat-sealing the peripheral parts of the packaging sheets. Particularly, automatic filling and packaging needs a complicated apparatus, requires troublesome work, and have significant problems in practical work.

The present invention has been made in view of the foregoing problems and it is therefore an object of the present invention to provide a fastener bag having both a capability to be opened easily and a capability to be reclosed, and capable of being used for automatic filling on an automatic filling and packaging machine, and to provide a fastening device.

DISCLOSURE OF THE INVENTION

According to a first aspect of the present invention, a fastener bag includes a packaging bag formed by heat-sealing side parts of a packaging sheet in a butt seam; and a fastening device attached to the inner surface of the packaging bag; wherein the fastening device includes separate male and female fastening members, the male fastening member is disposed on one side of the heat-sealed butt seam of the packaging bag, the female fastening member is disposed on the other side of the heat-sealed butt seam of the packaging bag so as to be engage with the male fastening member, and a tear-facilitating means is extended between the male and the female fastening member.

According to a second aspect of the present invention, a fastener bag includes a packaging bag formed by heat-sealing side parts of a packaging sheet in a butt seam; and a fastening device attached to a part of the inner surface of the packaging bag on one side of the heat-sealed butt seam; wherein the fastening device includes separate male and female fastening members, the male and the female fastening member are disposed with a space therebetween so as to be engaged, and a tear-facilitating means is interposed between the male and the female fastening member.

According to a third aspect of the present invention, a fastener bag includes a packaging bag formed by heat-sealing side parts of a packaging sheet in a butt seam; and a fastening device attached to the inner surface of the packaging bag; wherein the fastening device is an integral molding including a male fastening member, a female fastening member and a connecting member, and a tear-facilitating means is combined with the connecting member.

According to a fourth aspect of the present invention, a fastener bag includes a packaging bag formed by heat-sealing side parts of a packaging sheet in an envelope seam; and a fastening device attached to the inner surface of the packaging bag; wherein the fastening device is an integral molding including a male fastening member, a female fastening member and a connecting member, and a tear-facilitating means is combined with the connecting member.

According to a fifth aspect of the present invention, a fastener bag includes a packaging bag formed by heat-sealing side parts of a packaging sheet in a butt seam; and a fastening device attached to the inner surface of the packaging bag; wherein the fastening device includes separate male and female fastening members, the male fastening member is disposed on one side of the heat-sealed butt seam of the packaging bag, the female fastening member is disposed on the other side of the heat-sealed butt seam so as to engage with the male fastening member, and a cut tape is extended from one to the other end of the packaging bag on a part of the inner surface of the packaging bag between the male and the female fastening member, and is attached to the inner surface of the packaging bag.

According to a sixth aspect of the present invention, a fastener bag includes a packaging bag formed by heat-sealing side parts of a packaging sheet in a butt seam; and a fastening device attached to a part of the inner surface of the packaging bag on one side of the heat-sealed butt seam; wherein the fastening device includes separate male and female fastening members, the male and the female fastening member are disposed with a space therebetween so as to be engaged, and a cut tape is extended from one to the other end of the packaging bag on a part of the inner surface of the packaging bag between the male and the female fastening member, and is attached to the inner surface of the packaging bag.

According to a seventh aspect of the present invention, a fastener bag includes a packaging bag formed by heat-sealing side parts of a packaging sheet in an envelope seam; and a fastening device attached to the inner surface of the packaging bag; wherein the fastening device includes male and female fastening members, the male fastening member is disposed on one side of the heat-sealed envelope seam of the packaging bag, the female fastening member is disposed on the other side of the heat-sealed envelope seam of the packaging bag so as to be engaged with the male fastening member, and a cut tape is extended from one to the other end of the packaging bag on a part of the inner surface of the packaging bag between the male and the female fastening member, and is attached to the inner surface of the packaging bag.

According to an eighth aspect of the present invention, a fastening device includes separate male and female fastening members, wherein a linear member is combined with the male or the female fastening member.

BEST MODE FOR CARRYING OUT THE INVENTION

Preferred embodiments of the present invention will be described with reference to the accompanying drawings.

Figure 1:
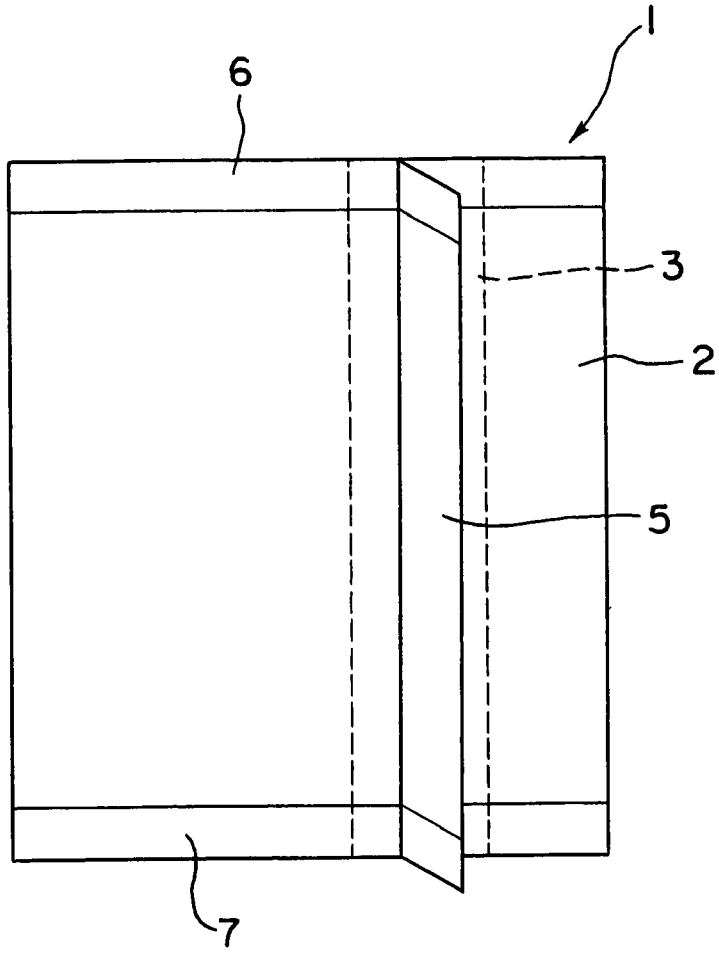
FIG. 1 is a rear view of a fastener bag in a first embodiment according to the present invention.

Referring to FIG. 1, a fastener bag 1 in a first embodiment according to the present invention includes a packaging bag 2, and a fastening device 3 welded or bonded to the inner surface of the packaging bag 2.

Figure 2:
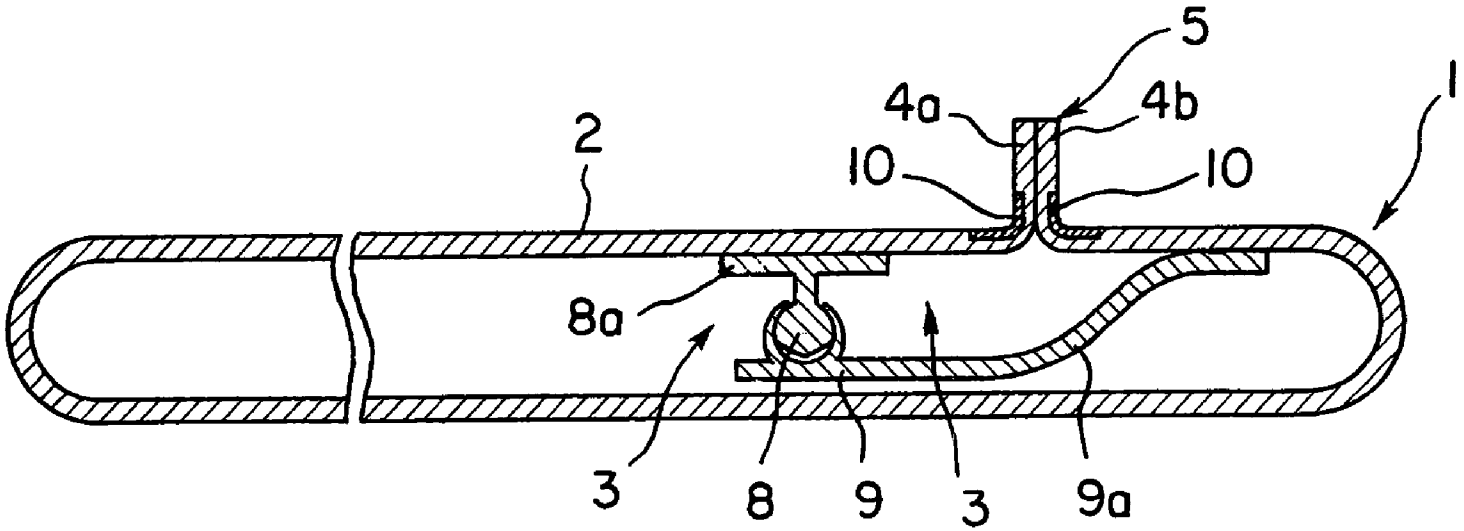
FIG. 2 is an enlarged sectional view of the fastener bag shown in FIG. 1.

As shown in FIGS. 1 and 2, the packaging bag 2 is formed by folding side parts 4*a* and 4*b* of a rectangular packaging sheet, joining the folded side parts 4*a* and 4*b* such that the inner surfaces thereof are contiguous, heat-sealing the thus joined folded side parts 4*a* and 4*b* to form a tubular structure having a back sealed part 5, and heat-sealing the upper and the lower end of the tubular structure to form an upper sealed part 6 and a lower sealed part 7.

Although it is preferably that the packaging sheet is a laminated film, the packaging sheet may be a single film.

Laminated films suitable as the packaging sheet for forming a transparent packaging bag 2 are a laminated film formed by laminating a 20 to 50 μm thick biaxially oriented polypropylene film, and a 20 to 60 μm thick nonoriented polypropylene film by a laminating process using a 2 to 3 μm thick dry bonding layer, a laminated film formed by laminating a 9 to 25 μm thick polyester film, and a 25 to 120 μm thick straight-chain, low-density polyethylene film by a laminating process using a 2 to 3 μm thick dry bonding layer, and a laminated film formed by laminating a 9 to 20 μm thick biaxial oriented nylon film, and a 25 to 120 μm thick polyethylene film by a laminating process using a 2 to 3 μm thick dry bonding layer. An extruded 12 to 20 μm thick polyethylene layer may be used as a bonding layer instead of the dry bonding layer.

Laminated films suitable as the packaging sheet for forming an opaque packaging bag 2 are a laminated film formed by laminating a 9 to 25 μm thick polyester film, a 6 to 30 μm thick aluminum foil, and a 20 to 120 μm thick straight-chain low-density polyethylene film by a laminating process using a 2 to 3 μm thick dry bonding layer, and a laminated film formed by laminating a 9 to 25 μm thick polyester film, a 12 μm thick aluminum-metallized polyester film, and a 20 to 60 μm thick nonoriented polypropylene film by a laminating process using a 2 to 3 μm thick dry bonding layer. A 12 to 20 μm thick extruded polyethylene layer may be used as a bonding layer instead of the dry bonding layer.

Referring to FIG. 2, the fastening device 3 includes a separate male fastening member 8 and a separate female fastening member 9. The male fastening member 8 has a base part 8*a* attached to a part of the inner surface of the packaging bag 2 on one side of the back sealed part 5. The female fastening member 9 has a base part 9*a* attached to a part of the inner surface of the packaging bag 2 on the other side of the back sealed part 5.

The male fastening member 8 and the female fastening member 9 are formed by extruding an olefin resin, such as a polyethylene, a polypropylene or a copolymer of a polyethylene and a polypropylene by an extrusion molding machine. Although the male fastening member 8 and the female fastening member 9 shown in FIG. 2 have each a single engaging part, the same may be provided with two or more engaging parts when necessary.

As shown in FIG. 2, the packaging bag 2 is provided with narrow roughened tear parts 10 in the outer surface of the laminated film forming the packaging bag 2. The narrow roughened tear parts 10 are formed along the back sealed part 5. The roughened tear parts 10 are those provided with scratches not penetrating the laminated film formed by pressing a sand paper against the laminated film. The roughened tear parts 10 are the tear-facilitating means of the packaging bag.

When opening the fastener bag 1, one end of the back sealed part 5 is held between fingers, the back sealed part 5 is pulled away from the surface of the fastener bag 1 to tear the laminated film along bends in the back sealed part provided with the roughened tear parts 10.

A method of manufacturing the fastener bag will be described.

A continuous laminated film is cut in a packaging sheet of a length equal to twice the sum of the width of the packaging bag 2 shown in FIG. 1 and the length of the back sealed part 5 of the packaging bag 2 to form the packaging bag 2 that can be used on an automatic filling and packaging machine. When folding the packaging sheet to form the packaging bag 2, at least one of the side parts 4*a* and 4*b* joined by heat-sealing to form the back sealed part 5 is provided with the roughened tear part 10. Preferably, both the side parts are provided with the roughened tear parts, respectively.

The side parts 4*a* and 4*b* are bent and are joined such that the inner surfaces thereof are contiguous to form a tubular structure. The roughened tear parts 10 formed in the packaging sheet extend along the bends of the side parts 4*a* and 4*b*.

Then, a continuous fastening device 3 with the male fastening member 8 and the female fastening member 9 engaged is inserted in the tubular structure such that the base part 8*a* of the male fastening member 8 is disposed on a part of the inner surface of the tubular structure on one side of the joint of the side parts 4*a* and 4*b*, and the base part 9*a* of the female fastening member 9 of the fastening device is disposed on a part of the inner surface of the tubular structure on the other side of the joint of the side parts 4*a* and 4*b*. Thus, the male fastening member 8 and the female fastening member 9 are disposed on the opposite sides of the joint of the side parts 4*a* and 4*b*, respectively.

Then, the joined side parts 4*a* and 4*b* of the tubular structure are bonded together by heat-sealing and, at the same time, the respective base parts 8*a* and 9*a* of the male fastening member 8 and the female fastening member 9 are welded or bonded to the inner surface of the tubular structure. Thus, the tubular structure having open opposite ends and provided with the fastening device 3 attached to its inner surface is formed.

Then, one end of the tubular structure fixedly provided with the fastening device 3 and having the opposite open ends is heat-sealed to form the lower heat-sealed part 7. Thus, the packaging bag 2 having an open upper end is obtained. An article is filled through the open upper end in the packaging bag 2, and then the upper end of the packaging bag 2 is heat-sealed to form the upper heat-sealed part 6. The packaging bag 2 filled with the article is cut along the upper heat-sealed part 6 to separate the packaging bag 2 from the packaging sheet.

Figure 3:
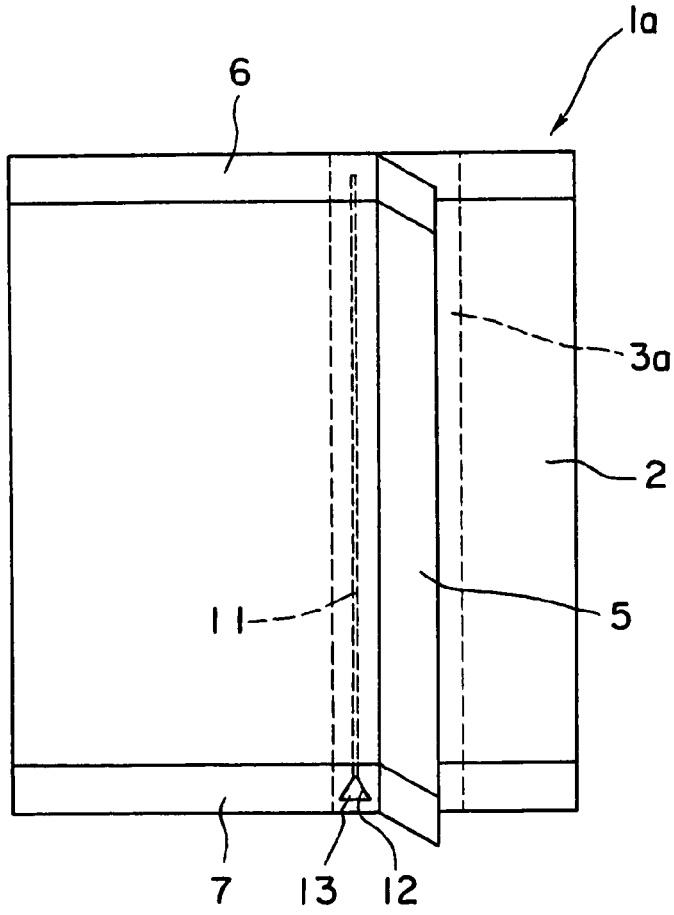
FIG. 3 is a rear view of a fastener bag in a second embodiment according to the present invention.
Figure 4:
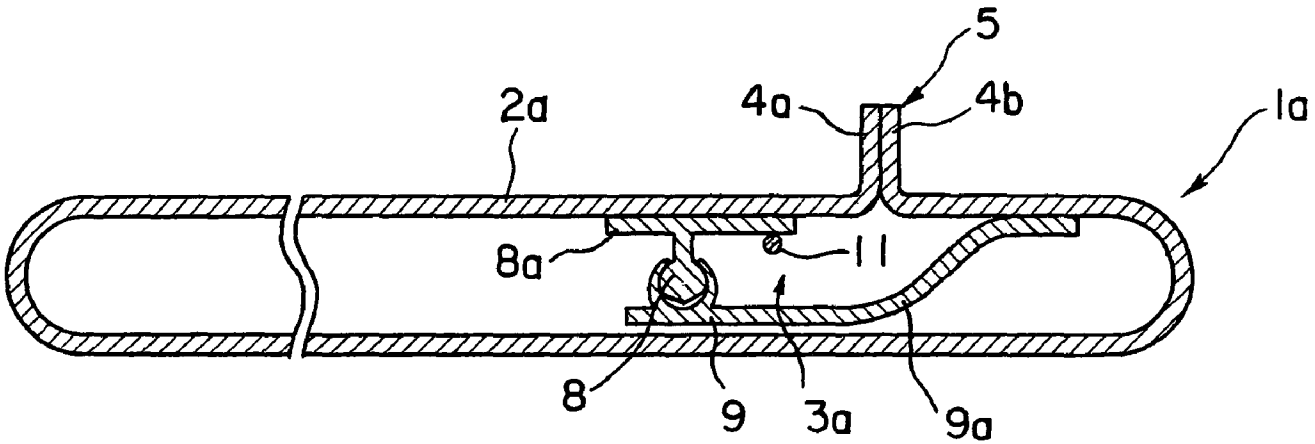
FIG. 4 is an enlarged sectional view of the fastener bag shown in FIG. 3.

FIGS. 3 and 4 show a fastener bag lain a second embodiment according to the present invention. The fastener bag 1*a* shown in FIGS. 3 and 4 differs from the fastener bag 1 shown in FIGS. 1 and 2 in that the fastener bag 1*a* is provided with a tear strip 11 as a tear-facilitating means combined with a fastening device 3*a* instead of the roughened tear parts 10 of the fastener bag 1 shown in FIGS. 1 and 2.

Referring to FIG. 4, the fastening device 3*a* includes a separate male fastening member 8 and a separate female fastening member 9. The tear strip 11 is attached temporarily to the inner surface of the base part of the male fastening member 8 by welding or bonding. The tear strip 11 may be attached temporarily to the outer surface of the base part 8*a* of the male fastening member 8. When the tear strip 11 is attached to the outer surface of the base part 8*a*, the respective positions of the male fastening member 8 and the female fastening member 9 on a packaging bag 2 are interchanged.

Although it is preferable that the tear strip 11 is made of a polymer different from that forming the packaging sheet and is, for example, a nylon monofilament or a metal wire, the tear strip 11 may be a cotton yarn or a silk yarn, provided that the tear strip 11 has a strength sufficient to tear both the base part 8*a* of the male fastening member 8 and the packaging sheet.

The male fastening member 8 and the female fastening member 9 of the fastening device 3*a* are formed by continuously extruding an olefin resin by an extrusion molding machine. The tear strip 11 can be combined with the male fastening member 8 or the female fastening member 9 by forming the tear strip 11 simultaneously with the male fastening member 8 or the female fastening member 9 by coextrusion.

As shown in FIG. 3, the fastening device 3*a* and the tear strip 11 are extended continuously between the upper and the lower end of the fastener bag 1*a*. A triangular pull tab 13 is formed by cutting lines 12 in a lower heat-sealed part 7 at a position corresponding to the tear strip 11 and an end of the tear strip 11 is connected to the pull tab 13.

When opening the fastener bag 1*a*, the lower heat-sealed part 7 is cut along the cutting lines 12 to separate the pull tab 13 from the lower heat-sealed part 7, and then the pull tab 13 is held between fingers and is pulled away from the fastener bag 1*a*. Consequently, the tear strip 11 connected to the pull tab 13 cuts both the base part 8*a* of the male fastening member 8 and the packaging sheet to open the fastener bag 1*a*.

Figure 5:
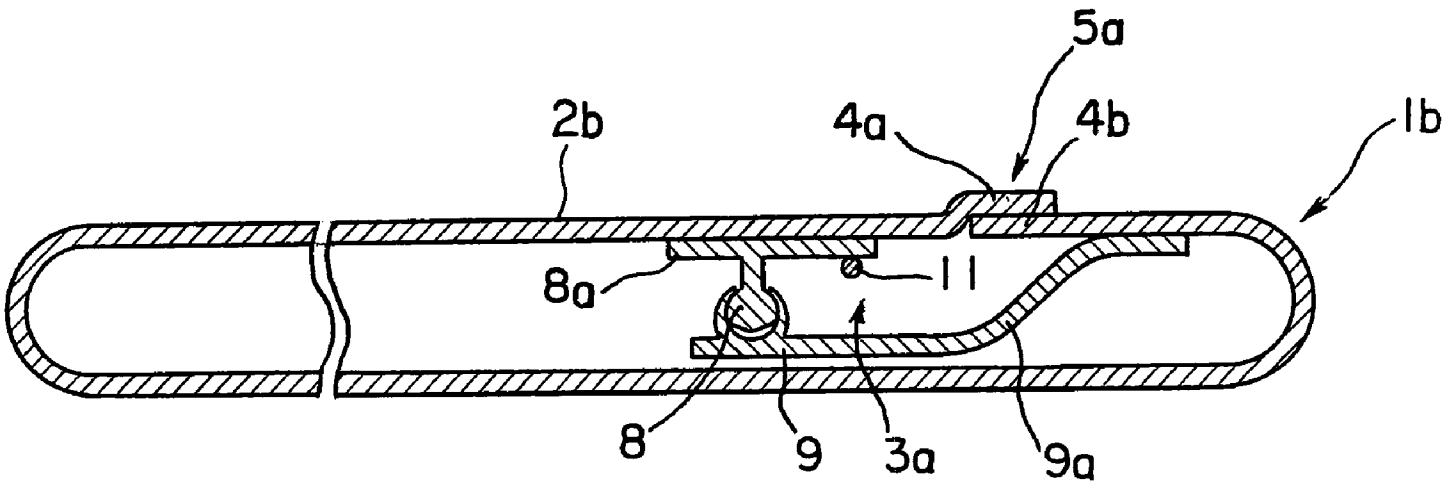
FIG. 5 is an enlarged sectional view of a fastener bag in a third embodiment according to the present invention.

Whereas the fastener bag 1*a* shown in FIG. 4 has the butt seam type packaging bag 2*a*, a fastener bag 1*b* shown in FIG. 5 has an envelope seam type packaging bag 2*b*.

The envelope seam type packaging bag 2*b* has an envelope seam 5*a* formed by superposing and joining together side parts of a packaging sheet. Laminated films suitable as the packaging sheet for forming the packaging bag 2*b* are a laminated film formed by laminating a 20 to 60 μm thick nonoriented polypropylene film, a 20 to 50 μm thick biaxially oriented polypropylene film, and a 20 to 60 μm thick nonoriented polypropylene film by a laminating process using a 2 to 3 μm thick dry bonding layer, a laminated film formed by laminating a 30 to 50 μm thick straight-chain low-density polyethylene film, a 9 to 25 μm thick polyester film, and a 25 to 120 μm thick straight-chain, low-density polyethylene film by a laminating process using a 2 to 3 μm thick dry bonding layer, and a laminated film formed by laminating a 25 to 60 μm thick polyethylene film, a 9 to 20 μm thick biaxial oriented nylon film, and a 25 to 120 μm thick polyethylene film by a laminating process using a 2 to 3 μm thick dry bonding layer. An extruded polyethylene layer may be used as a bonding layer instead of the dry bonding layer.

Figure 6:
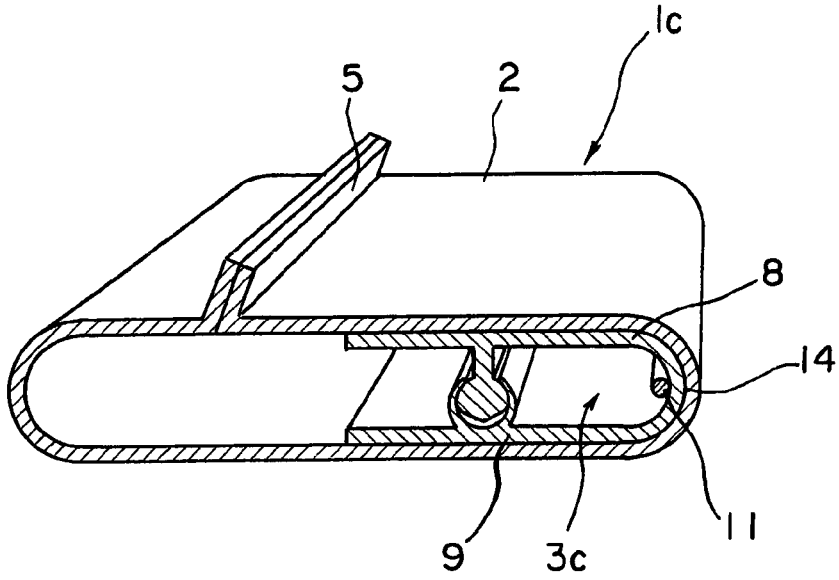
FIG. 6 is an enlarged, sectional, perspective view of a fastener bag in a fourth embodiment according to the present invention.

A fastening device 3*c* included in a fastener bag 1*c* shown in FIG. 6 is different in construction from that included in the fastener bag 1*b* shown in FIG. 5. The fastening device 1*c* shown in FIG. 6 is a molding integrally having a male fastening member 8, a female fastening member 9, and a connecting part 14 interconnecting the male fastening member 8 and the female fastening member 9. A tear strip 11, i.e., a tear-facilitating means, is attached to the inner surface of the connecting part 14.

The fastening device 3*c* and the tear strip 11 of the fastener bag 1*c*, similarly to the fastening device 3*a* and the tear strip 11 shown in FIG. 2, are extended between the upper and the lower end of a packaging bag 2, a triangular pull tab is formed by cutting lines in a lower heat-sealed part and an end of the tear strip 11 is connected to the pull tab.

Figure 7:
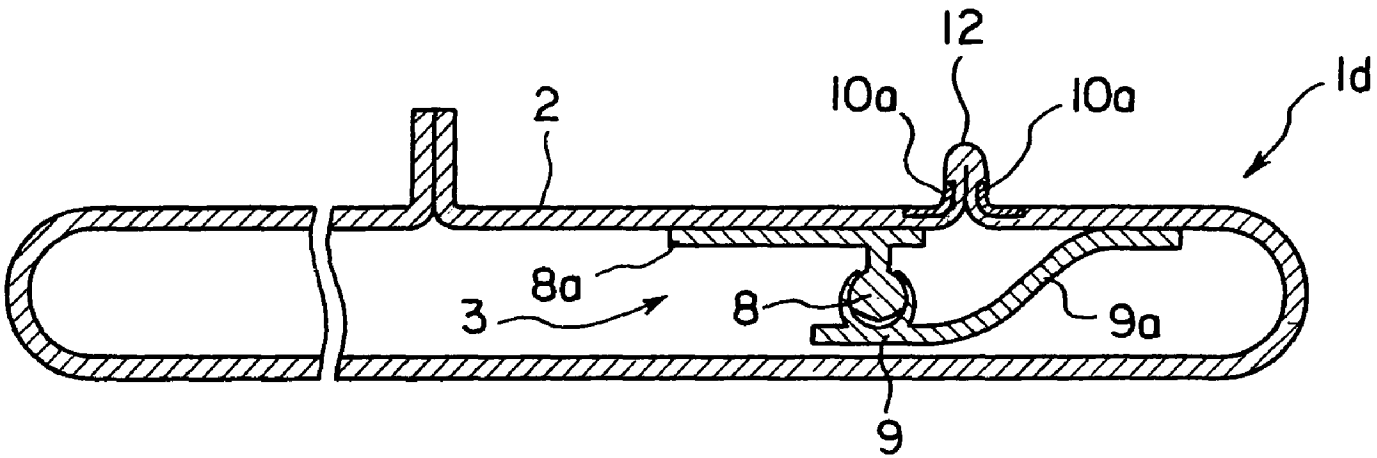
FIG. 7 is an enlarged sectional view of a fastener bag in a fifth embodiment according to the present invention.

A fastener bag 1*d* shown in FIG. 7 differs from the fastener bag 1 shown in FIG. 2 in that a fastening device 3 is extended on the inner surface of a packaging bag 2 along a butt seam 5 on one side of the butt seam 5, a ridge 12 extending along the fastening device 3 is formed in a part of the packaging bag 2 between a base part 8*a* of a mal fastening member 8, and a base part 9*a* of a female fastening member 9, and roughened tear parts 10*a*, i.e., tear-facilitating means, are formed at the root of the ridge 12.

Figure 8:
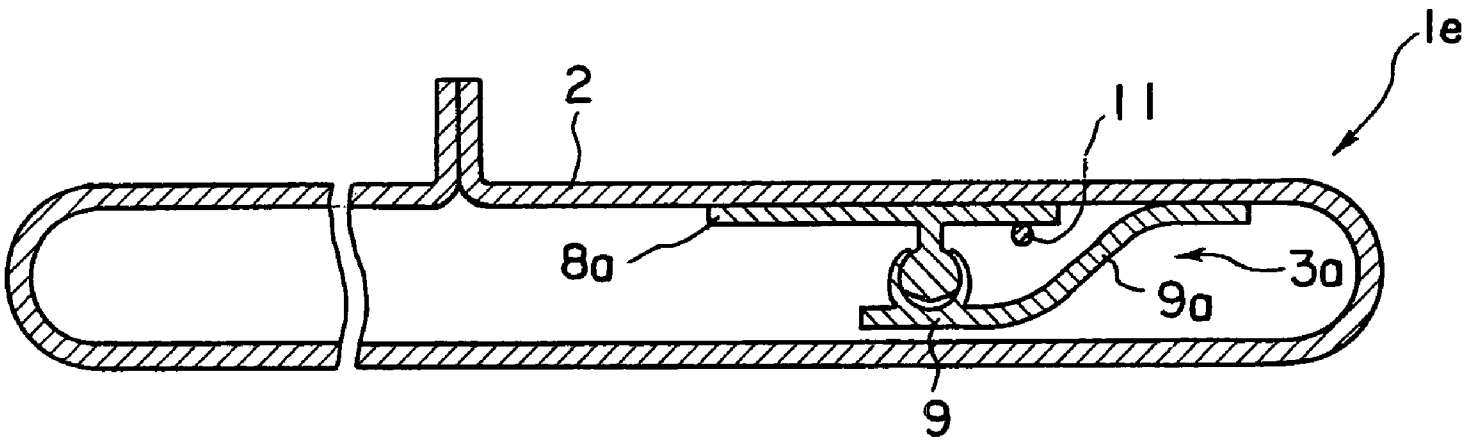
FIG. 8 is an enlarged sectional view of a fastener bag in a sixth embodiment according to the present invention.

A fastener bag 1*e* shown in FIG. 8 is not provided with any part corresponding to the ridge 12 of the packaging bag 2 of the fastener bag 1*d* shown in FIG. 7, and is provided with a fastening device 3*a* instead of the fastening device 3. In the fastener bag 1*e* shown in FIG. 8, a part of the packaging bag 2 between a base part 8*a* of a male fastening member 8, and a base part 9*a* of a female fastening member 9 is cut with a tear strip 11. Although the fastener bag 1*e* shown in FIG. 8 employs the tear strip 11 as a cutting means for cutting the packaging bag 2, the tear strip 11 may be omitted, and a tape may be welded or bonded to a part of the inner surface of the packaging bag 2 between the base part 8*a* of the male fastening member, and the base part 9*a* of the female fastening member 9 or a narrow roughened tear part may be formed near the respective base parts 8*a* and 9*a* of the male fastening member 8 and the female fastening member 9, and a cut tape or the narrow roughened tear part may be torn to open the packaging bag 2.

The cut tape is formed from, for example, a laminated film formed by sandwiching a 12 μm thick polyester film between 30 μm thick polyethylene films. The cut tape is formed in a width slightly smaller than the distance between the respective base parts 8*a* and 9*a* of the male fastening member 8 and the female fastening member 9 so that the cut tape is guided by the base part 8*a* of the male fastening member 8 or the base part 9*a* of the female fastening member 9 when cutting the packaging bag 2 with the cut tape.

Figure 9:
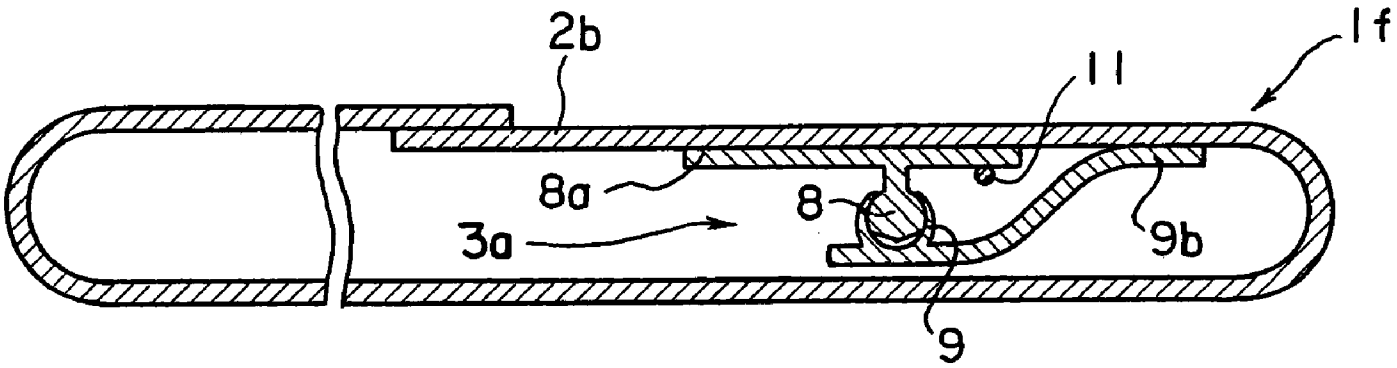
FIG. 9 is an enlarged sectional view of a fastener bag in a seventh embodiment according to the present invention.

Whereas the fastener bag 1*e* shown in FIG. 8 has the butt seam type packaging bag 2, a fastener bag if shown in FIG. 9 has an envelope seam type packaging bag 2*b*.

Figure 10:
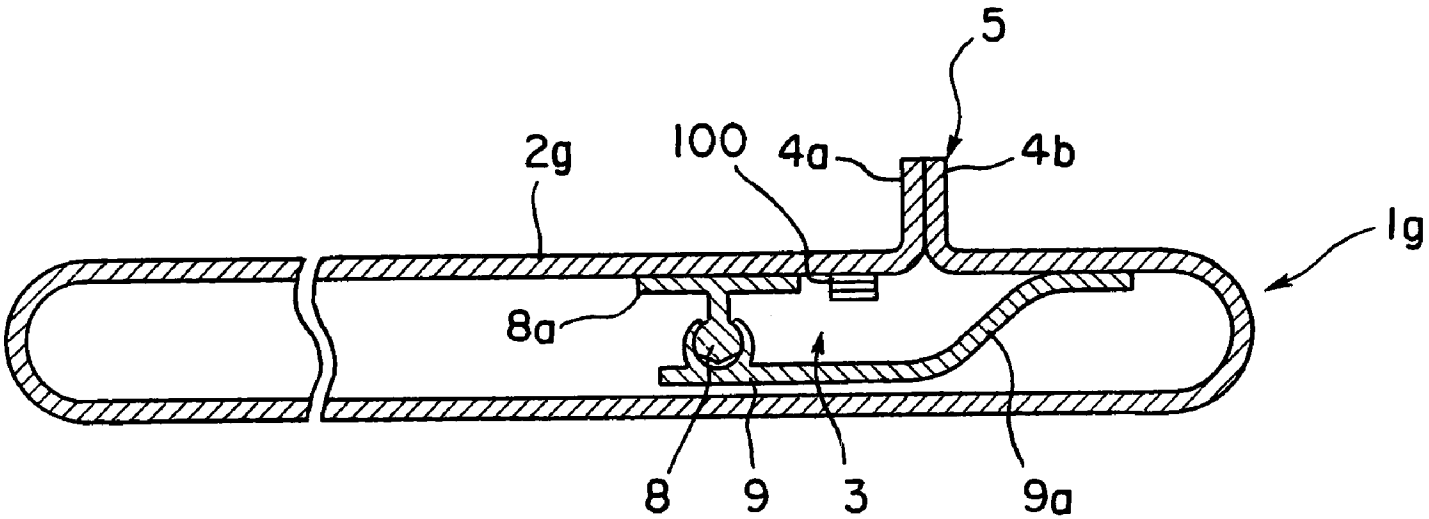
FIG. 10 is an enlarged sectional view of a fastener bag in an eighth embodiment according to the present invention.

A fastener bag 1*g* shown in FIG. 10 is provided with a cut tape 100 as a tear-facilitating means instead of the roughened tear part 10 of the fastener bag 1 shown in FIG. 2.

The cut tape 100 of the fastener bag 1*g* is attached to a part of the inner surface of a packaging bag 2*b* between a base part 8*a* of a male fastening member 8 and a back sealed part 5 formed in the packaging bag 2*g*. The cut tape 100 serves as a tear-facilitating means for opening the packaging bag 2*g*. Two longitudinal cutting lines may be formed in the cut tape 100, and a part between the two cutting lines of the cut tape may be used as a tear-facilitating means.

The cut tape 100 has a width in the range of 3 to 15 mm. The cut tape 100 is extended continuously between an upper heat-sealed part 6 and a lower heat-sealed part 7 of the packaging bag 1*g* on a part of the packaging bag 2*g* between the male fastening member 8 and the female fastening member 9. A triangular pull tab is formed in at least either the upper heat-sealed part 6 or the lower heat-sealed part 7 by cutting lines. The cutting line separates a part of the heat-sealed part to form the pull tab integrally with the cut tape 100 at one end of the cut tape 100.

Figure 11:
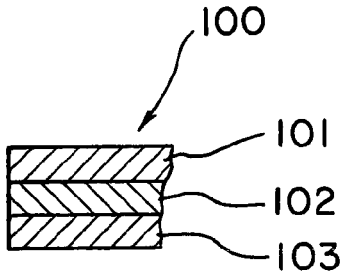
FIG. 11 is a fragmentary sectional view of a cut tape.

As shown in FIG. 11, the cut tape 100 is a three-layer structure consisting of a straight-chain low-density polyethylene layer 101, a polyester layer 102, and an easy-to-peel layer 103. The easy-to-peel layer 103 is formed of a chlorinated polyethylene or an EVA, or is a hot-melt layer. The easy-to-peel layer 103 has a peeling strength on the order of 200 g/cm.

A packaging sheet forming the packaging bag 2*g* has a breaking strength higher than the peeling strength of the easy-to-peel layer 103 of the cut tape 100.

The cut tape 10 may be a four-layer structure consisting of a low-density polyethylene layer, a polyester layer, a low-density polyethylene layer and an easy-to-peel layer, a four-layer structure consisting of a straight-chain low-density polyethylene layer, a polyester layer, a straight-chain low-density polyethylene layer and an easy-to-peel layer, a four-layer structure consisting of a very-low-density polyethylene layer, a polyester layer, a very-low-density polyethylene layer and an easy-to-peel layer or a four-layer structure consisting of a cast polypropylene layer, a polyester layer, a cast polypropylene layer and an easy-to-peel layer.

A method of manufacturing the fastener bag 1*g* will be described.

A continuous laminated film is cut in a packaging sheet of a length equal to twice the sum of the width of the packaging bag 2*g* shown in FIG. 10 and the length of the back sealed part 5 of the packaging bag 2*g* to form the packaging bag 2*g* that can be used on an automatic filling and packaging machine.

Side parts 4*a* and 4*b* are bent and are joined such that the inner surfaces thereof are contiguous to form a tubular structure. Then, a continuous fastening device 3 with the male fastening member 8 and the female fastening member 9 engaged and the cut tape 100 are inserted in the tubular structure.

The male fastening member 8 and the female fastening member 9 are disposed on the opposite sides, respectively, of the joint of the side parts 4*a* and 4*b*. The cut tape 100 is extended continuously between the upper and the lower end of the tubular structure on a part between the base part 8*a* of the male fastening member 8 and the base part 9*a* of the female fastening member 9 of the tubular structure.

Then, the joined side parts 4*a* and 4*b* of the tubular structure are bonded together by heat-sealing to form the back sealed part 5 and, at the same time, the respective base parts 8*a* and 9*a* of the male fastening member 8 and the female fastening member 9 are welded or bonded to the inner surface of the tubular structure. Thus, the tubular structure having open opposite ends and provided with the fastening device 3 and the cut tape 100 attached to its inner surface is formed. The easy-to-peel layer 103 of the cut tape 100 is bonded to the base part 9*a* of the female fastening member 9.

Then, one end of the tubular structure fixedly provided with the fastening device 3 and the cut tape 100, and having the opposite open ends is heat-sealed to form a lower heat-sealed part 7. Thus, the packaging bag 2*g* having an open upper end is obtained. An article is filled through the open upper end in the packaging bag 2*g*, and then the upper end of the packaging bag 2*g* is heat-sealed to form the upper heat-sealed part 6. The packaging bag 2*g* filled with the article is cut along the upper heat-sealed part 6 to separate the packaging bag 2*g* from the packaging sheet.

When opening the fastener bag 1*g* to take out the contents, the upper heat-sealed part 6 or the lower heat-sealed part 7 is cut along the cutting lines to form a tab separated from the heat-sealed part.

Then, the tab is held between fingers and is pulled away from the surface of the fastener bag 1*g* to cut a part of the packaging bag 2*g* between the respective base parts 8*a* and 9*a* of the male fastening member 8 and the female fastening member 9 with the cut tape 100. Consequently, the fastener bag 1*g* is opened and the contents can be taken out of the fastener bag 1*g* through an opening formed by cutting the packaging bag 2*g* with the cutting tape 100.

The remnant contents remaining in the fastener bag 1*g* after taking out some of the contents can be sealed in the fastener bag 1*g* by engaging the male fastening member 8 and the female fastening member 9.

Figure 12:
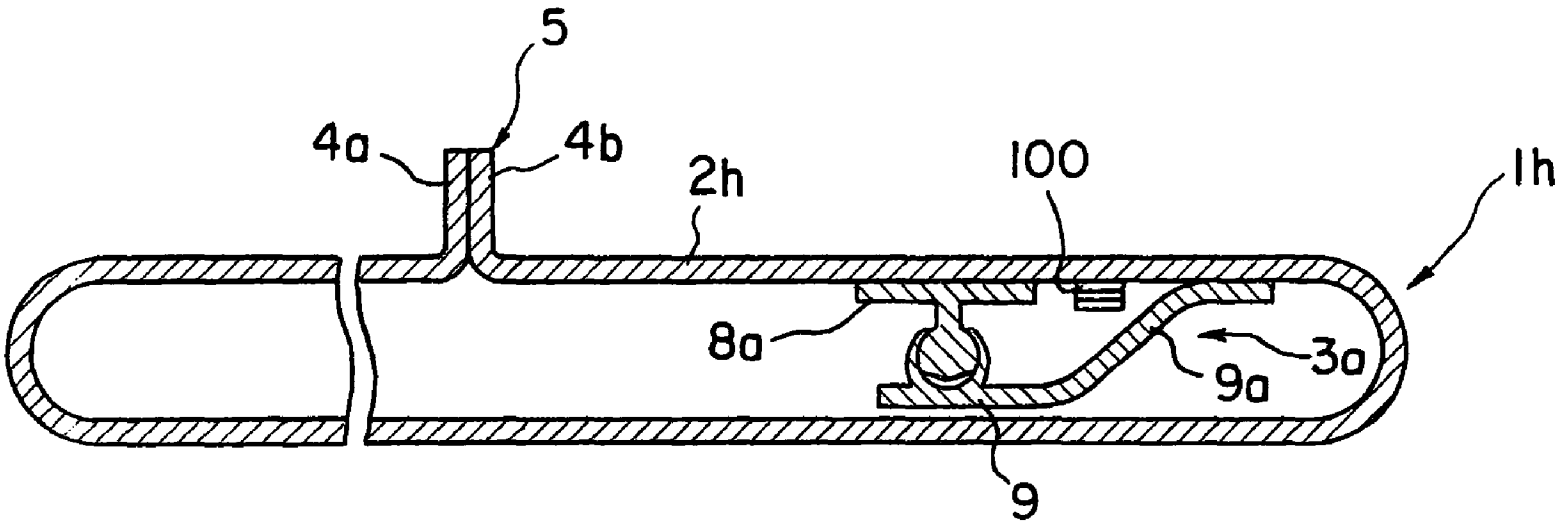
FIG. 12 is an enlarged sectional view of a fastener bag in a ninth embodiment according to the present invention.

A fastener bag 1*h* in a preferred embodiment of the present invention shown in FIG. 12 has a packaging bag 2*h* identical with the packaging bag 2*g* of the fastener bag 1*g* shown in FIG. 10. The fastener bag 1*h* differs in the position of its fastening device 3*a* from the fastener bag 1*g* shown in FIG. 10.

In the fastener bag 1*h*, both the male fastening member 8 and the female fastening member 9 of the fastening device 3*a* are disposed on the inner surface of the packaging bag 2*g* shown in FIG. 10 on one side of the back sealed part 5.

A part of the fastener bag 1*h* apart from the back sealed part 5 is cut to open the fastener bag 1*h*.

Figure 13:
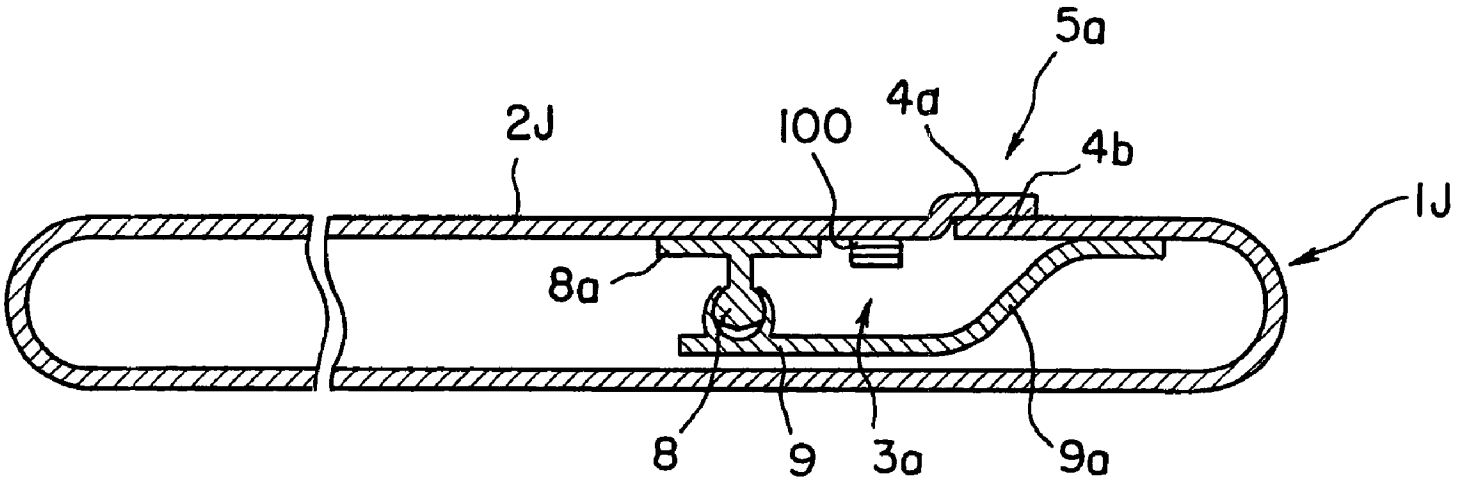
FIG. 13 is an enlarged sectional view of a fastener bag in a tenth embodiment according to the present invention.

A jip bag 1*j* in a preferred embodiment according to the present invention shown in FIG. 13 is identical in the position of its fastening device 3 with the fastener bag 1*g* shown in FIG. 10. Where as the packaging bag 2*g* of the fastener bag 1*g* is of a butt seam type, the packaging bag 2*j* of the fastener bag 1*j* is of an envelope seam type.

INDUSTRIAL APPLICABILITY

The fastener bag according to the present invention has the packaging bag formed by processing a single packaging sheet, the fastening device is disposed on one of the walls of the packaging bag, and the tear-facilitating means is placed on the inner surface of the packaging bag or the fastening device. Thus, the fastener bag can be opened and reclosed and can be used on an ordinary automatic filling and packaging machine without requiring any special devices.

The fastener bag according to the present invention has the packaging bag formed by processing a single packaging sheet, the fastening device is disposed on one of the walls of the packaging bag, and the cut tape is attached to the inner surface of the packaging bag. Thus, the fastener bag can be opened and reclosed and can be used on an ordinary automatic filling and packaging machine without requiring any special devices.

The invention claimed is:

1. A fastener bag comprising:

a packaging bag having a packaging bag body formed as a tubular structure for containing an article therein, and a heat-sealed butt seam, the packaging bag body and the heat-sealed butt seam being formed by folding one sheet of a packaging sheet and by two heat-sealing side parts of the packaging sheet so that the packaging bag body and the heat-sealed butt seam directly adjoin each other; and a fastening device attached to an inner surface of the packaging bag body;

wherein the fastening device includes separate male and female fastening members, the male fastening member is disposed at a position on the packaging body except at a position of the heat-sealed butt seam and on one side of the heat-sealed butt seam of the packaging bag body, the female fastening member is disposed at a position on the packaging body except at the position of the heat-sealed butt seam and on the other side of the heat-sealed butt seam of the packaging bag body so as to be engaged with the male fastening member, and the female fastening member having a female base part which is bonded to an inner surface of the packaging bag body and a female fastening part projecting from the female base part, the male fastening member having a male base part which is bonded to the inner surface of the packaging bag body and a male fastening part projecting from the male base part and being capable of being fastened with the female fastening part, one of the female base part and the male base part is bonded to the inner surface of the packaging bag body on a same surface positioned on a same side to a corresponding one of the female fastening part and the male fastening part, and the other of the female base part and the male base part is bonded to the inner surface of the packaging bag body on an opposite surface positioned to an opposite side to a corresponding other of the female fastening part and the male fastening part, and further comprising:

a tear-facilitating means is disposed between the male base part and the female base part.

2. The fastener bag according to claim 1, wherein the tear-facilitating means is a narrow easy-to tear part formed near the heat-sealed butt seam.

3. The fastener bag according to claim 1, wherein the tear-facilitating means is a linear member attached to an inner or an outer surface of the male base part of the male fastening member.

4. The fastener bag according to claim 1, wherein the tear-facilitating means is a linear member attached to an inner or an outer surface of the female base part of the female fastening member.

5. The fastener bag according to claim 1, wherein each of the two heat-sealing side parts includes a bent portion having an angle substantially equal to 90°, each of the bent portions being contiguous to the tubular structure.

6. The fastener bag according to claim 1, wherein the tear-facilitating means includes a roughened tear part formed on an outer side of each of the two heat-sealing side parts.

7. The fastener bag according to claim 1, wherein each of the two heat-sealing side parts includes a bent portion, and wherein the tear-facilitating means includes a roughened tear part formed on an outer side of each of the bent portions.

8. The fastener bag according to claim 1, wherein only a portion of a length the female base part is bonded to the inner surface of the tubular structure, whereas an entire length of the male part is bonded to the inner surface of the tubular structure.

9. The fastening bag according to claim 1, wherein the female base part and the male base part are shaped differently from each other.

* * * * *